US010563468B2

(12) United States Patent
Hou et al.

(10) Patent No.: US 10,563,468 B2
(45) Date of Patent: Feb. 18, 2020

(54) AUTOMATIC AUXILIARY WORKOVER RIG

(71) Applicant: TONG RI INDUSTRIAL ROBOT CO., LTD., Shandong (CN)

(72) Inventors: Shuwang Hou, Shandong (CN); Hongjie Zhao, Shandong (CN); Chongzhen Zhao, Shandong (CN); Renhua Ba, Shandong (CN); Tonghai Yang, Shandong (CN); Tongxin Cai, Shandong (CN); Shuyin Tian, Shandong (CN); Xiangfu Li, Shandong (CN)

(73) Assignee: TONG RI INDUSTRIAL ROBOT CO., LTD., Shandong (CN)

( * ) Notice: Subject to any disclaimer, the term of this patent is extended or adjusted under 35 U.S.C. 154(b) by 336 days.

(21) Appl. No.: 15/522,288

(22) PCT Filed: Oct. 15, 2015

(86) PCT No.: PCT/CN2015/000697
§ 371 (c)(1),
(2) Date: Apr. 27, 2017

(87) PCT Pub. No.: WO2016/065734
PCT Pub. Date: May 6, 2016

(65) Prior Publication Data

US 2017/0314346 A1 Nov. 2, 2017

(30) Foreign Application Priority Data

Oct. 27, 2014 (CN) ..... 2014 1 0584164

(51) Int. Cl.
*E21B 15/00* (2006.01)
*E21B 19/06* (2006.01)
(Continued)

(52) U.S. Cl.
CPC ..... *E21B 19/155* (2013.01); *E21B 15/00* (2013.01); *E21B 19/06* (2013.01); *E21B 19/15* (2013.01); *E21B 19/163* (2013.01); *E21B 19/24* (2013.01)

(58) Field of Classification Search
CPC ..... E21B 19/155; E21B 19/00
See application file for complete search history.

(56) References Cited

U.S. PATENT DOCUMENTS 4,591,006 A 5/1986 Hutchison et al.

FOREIGN PATENT DOCUMENTS

CN 1609407 4/2005
CN 1920239 2/2007
(Continued)

OTHER PUBLICATIONS

"International Search Report (Form PCT/ISA/210)", dated Jan. 21, 2016, with English translation thereof, pp. 1-7.

*Primary Examiner* — Giovanna C Wright
*Assistant Examiner* — Brandon M Duck
(74) *Attorney, Agent, or Firm* — JCIPRNET

(57) ABSTRACT

An automatic auxiliary workover rig includes a silo body arranged on a skid-mounted baseplate, a guide-roller type elevator, a random-folding type traveling block rigid guide device, a truck-mounted folding type manipulator, a slip, a flatcar up-down adjustment device, a detecting and conveying device, and a transfer device. The automatic auxiliary workover rig cooperates with an existing workover rig to complete ascending and descending of a sucker rod of an oil pipe during minor overhaul. The slip is located above a wellhead blowout preventer, and is configured to clamp and loosen the oil pipe of a wellhead. The silo body is configured to store and output the oil pipe. The truck-mounted folding type oil pipe manipulator garbs the oil pipe and then ascend
(Continued)

and descend the oil pipe, meanwhile the manipulator is equipped with a height adjusting device to realize flexible joint in tube thread fastening and unfastening.

8 Claims, 18 Drawing Sheets

(51) Int. Cl.

| | |
|---|---|
| ***E21B 19/15*** | (2006.01) |
| ***E21B 19/16*** | (2006.01) |
| ***E21B 19/24*** | (2006.01) |

(56) References Cited

FOREIGN PATENT DOCUMENTS

| | | |
|---|---|---|
| CN | 102877802 | 1/2013 |
| CN | 203603787 | 5/2014 |
| CN | 104314483 | 1/2015 |
| CN | 204200110 | 3/2015 |

AUTOMATIC AUXILIARY WORKOVER RIG

CROSS-REFERENCE TO RELATED APPLICATION

This application is a 371 application of an international PCT application serial no. PCT/CN2015/000697, filed on Oct. 15, 2015, which claims priority to and the benefit of China Patent Application No. CN201410584164.3, filed on Oct. 27, 2014, disclosures of which are incorporated herein by reference in its entirety.

BACKGROUND OF THE INVENTION

1. Field of the Invention

The present invention discloses an auxiliary device relating to workover operations for oilfields, and specifically is an automatic auxiliary workover rig suitable for matching automation of an existing petroleum well.

2. Description of Related Art

During a production process of an oil well, often some oil well or device failures occur, resulting in a reduction of output or even shut down. In order to enable an oil well to restore a normal production, corresponding measures need to be adopted, so as to remove failures. Workover operation is an important link in a production process of an oilfield, is a labor-intensive industry for recent years, a work environment thereof is tough, labor intensities of operators are great, and potential risks to personal safety often exist during the operation process. Particularly, minor overhaul to a wellhead is often performed outdoors, and has a lot of contents, for example, including: preparatory work for ascending, well flushing operation, ascending and descending of a sucker rod and an oil pipe, descending of a sand-flushing pipe, sand washing, ascending of the sand-flushing pipe, descending of the sucker rod of the oil pipe, oil leakage, well intersecting, conveying, and other operations. In addition, conditions of the oil well change, and proper production measures need to be adopted according to the new condition, for example, converting into a beam well from a blow well, changing a landing depth and type of a defueling pump. At this time, these measures all need to perform workover operations and conventional workover operations. At present, workover, particularly ascending and descending processes of a sucker rod of the oil pipe, in China are still operated by operators. Minor overhaul to the wellhead is a link of the workover process that has the highest labor intensity and the highest repetition rate of work, and is the most dangerous. With development of the petroleum industry, there are higher requirements for mechanization and automatic numerical control of oil extraction, low pollution, lowering labor intensity of workers, and improving safety, human comfort, and "industrialized oil extraction", i.e., wellhead automation, energy conservation, and environmental protection. Achieving automatic numerical control of the wellhead is a development trend of the oilfield.

SUMMARY OF THE INVENTION

Based on the prior art, the present invention invents a numerical-controlled auxiliary workover rig which cooperates with an existing workover rig to achieve that the workover rig changes from being manually operated by operators into being numerical-controlled, reduce pollution, lower labor intensity of workers, and improve a production efficiency and safety.

In order to achieve the above, the invention adopts the following technical solution. An automatic auxiliary workover rig, having a baseplate assembly, a silo, a folding type traveling block rigid guide device, a guide-roller type elevator, a truck-mounted folding type oil pipe manipulator, a detecting and conveying device, and a transfer device; the folding type traveling block rigid guide device being hingedly connected to a rear end of the baseplate assembly, the guide-roller type elevator being mounted on the folding type traveling block rigid guide device, a portion of the truck-mounted folding type oil pipe manipulator being also hingedly connected to the rear end of the baseplate assembly and operating between the detecting and conveying device and the guide-roller type elevator, the silo being mainly a silo body and being provided on a baseplate. The transfer device used in cooperation with the silo to be responsible for leading in and out of an oil pipe is located at a left side of the silo and provided on the baseplate assembly. The detecting and conveying device used in cooperation with the silo has functions of detection, positioning, and transferring-being and is located at a right side of the silo and further provided on the baseplate assembly.

The baseplate assembly comprises a baseplate, rams, and hydraulic legs, there are four hydraulic legs which are provided nearby four corners at two sides of the baseplate, so as to support the baseplate, the hydraulic legs are connected to the rams, and the rams are connected to the baseplate by using respective hydraulic cylinders to which the rams are connected.

The folding type traveling block rigid guide device comprises a retractable guide device and a guide rail driving device; the retractable guide device comprising a guide rail, a hydraulic pipe tongs swiveling device, and a base; a bottom portion of the guide rail is hingedly connected to the base; the base is connected to the baseplate assembly; both the guide-roller type elevator and the hydraulic pipe tongs swiveling device are mounted on the guide rail; the guide rail driving device comprises a hydraulic motor, a pull rod, a sliding car, a decelerator, a transmission shaft, and a sprocket; two ends of a top portion of the silo body are respectively provided with the sprocket to be connected by a chain; the sliding car is provided on the chain; one end of the pull rod is hingedly connected to the sliding car, and the other end is hingedly connected to the guide rail; the hydraulic motor is connected to and drives the sprocket located at a beginning end by using the decelerator and the transmission shaft; then the chain is driven by the sprocket, so as to pull the sliding car; and the sliding car then pulls up and folds the retractable guide device by using the pull rod.

The automatic auxiliary workover rig further comprises a flatcar up-down adjustment device which comprises a left-right adjustment device and a front-rear adjustment device; the left-right adjustment device is mounted at a position near a rear section of the baseplate assembly in a left-right direction, and comprises a push rod and an oil cylinder; one end of the push rod is hingedly connected to the baseplate assembly, and the other end is hingedly connected to an earring at a cylinder head of the oil cylinder, wherein a position at which the push rod and the baseplate assembly are hingedly connected is inserted into a rectangular groove of a trailer by using a shaft; an earring at a cylinder bottom of the oil cylinder is hingedly connected to the baseplate assembly; when the oil cylinder pushes, a shaft at the position at which the push rod and the baseplate assembly are hingedly connected moves in the groove of the trailer; because the trailer stops on the ground and does not move, according to the principle of relative motion, the oil cylinder pushes the baseplate to move by using the push rod and a body of the oil cylinder; and the front-rear adjustment device is mounted at a position near a front section of the baseplate assembly in a front-rear direction, and having a same structure as that of the left-right adjustment device.

The silo body may temporarily store some sucker rods of the oil pipe, and an internal of the silo body comprises a two-dimensional palletizing manipulator which can connect the oil pipe from internal and external of the silo body; the palletizing manipulator is mounted on a horizontal guide rail, and two ends of the horizontal guide rail are mounted on a vertical guide rail; the palletizing manipulator grabs the oil pipe along left-right and up-down movements of the horizontal guide rail and the vertical guide rail; the vertical guide rail is fixed on the silo body; a top portion of the silo body is provided with an upper connection cap; and two sides of the silo body are provided with a balancing device connected to the vertical guide rail, so as to balance dead weights of the horizontal and the vertical guide rails.

The detecting and conveying device comprises a swing frame, a length measuring oil cylinder, conveying swing arms, a cross beam, a base, and swinging oil cylinders, the swing frame is mounted on the conveying swing arms for connecting and placing the oil pipe; the length measuring oil cylinder is mounted below the swing frame; the oil pipe is positioned through shrinkage and extension of the length measuring oil cylinder, so that a length of the oil pipe is able to be measured by using a linear encoder to calculate the shrinkage and extension of the length measuring oil cylinder; there are two conveying swing arms which are provided at the front and the rear; the two swing arms are connected by a cross beam so as to be synchronous; swinging oil cylinders are provided within the conveying swing arms; the swinging oil cylinders are respectively hingedly connected to the base and the conveying swing arms, and are driven to swing around the base due to a swinging of the oil pipe, so as to lead the oil pipe into and out from the silo; the base is further connected to the baseplate assembly and is at a right side of the silo, i.e., being at a same side with the truck-mounted folding type oil pipe manipulator; during a transporting state of the automatic auxiliary workover rig, the swinging oil cylinders completely extend out, so that an end surface of the conveying swing arms is in contact with the base.

The transfer device comprises a transferring swing arm, a swinging oil cylinder, an ejecting slide block, a push plate, a lifting oil cylinder, and a base; the base is fixed at a side of the silo that is away from a wellhead; a front end of the swinging oil cylinder is hingedly connected to a bottom portion at a front end of the transferring swing arm, and a rear end is hingedly connected to the base; the ejecting slide block is provided at an upper end of the base and directly behind of the transferring swing arm; the lifting oil cylinder is provided below the ejecting slide block; a right side of the ejecting slide block is provided with an adjustment push plate which comprises the push plate and an adjusting bolt at a back surface of the push plate; the sucker rods of the oil pipe are placed on the transferring swing arm; the transferring swing arm is pushed by the swinging oil cylinder to turn over; a distance from a front side to a rear side of the push plate is adjusted, so that when the ejecting slide block is lifted by the lifting oil cylinder, only one sucker rod of the oil pipe is allowed to be lifted by the ejecting slide block and the transferring swing arm is pushed to be in a vertical state when the automatic auxiliary workover rig is transporting.

The guide-roller type elevator comprises a guide pulley, a guide plate, an elevator oil cylinder, a push rod, an elevator body, a holding sleeve, a pin shaft, a suspension ring, and a swing block; the guide pulley is fixed on the guide plate; the guide pulley moves up and down along the guide rail in the folding type traveling block rigid guide device, thereby achieving rigid guide of the guide-roller type elevator; the guide plate is fixed on the elevator body; a center of the elevator body is provided with holding sleeve which is longitudinally disposed; the swing block is hingedly connected within the elevator and at two sides of the holding sleeve; the oil pipe passing through a sleeve is clamped or loosened through rotation of the swing block; the guide plate is provided with the elevator oil cylinder which is connected to the push rod; a lower end of the push rod is hingedly connected to the swing block; the sleeve is driven to clamp or loosen a pipe ferrule of the oil pipe as the swing block is driven by the elevator oil cylinder, so as to make sure synchronism of the clamping and loosening of the pipe ferrule by the holding sleeve; the holding sleeve may be changed according to different models of the oil pipe; and the elevator body is configured to be connected to the suspension ring through the pin shaft.

The truck-mounted folding type oil pipe manipulator comprises a pendulum, a swinging manipulator, and a flexible manipulator; the pendulum comprises a swing block, a pendulum base, a swinging oil cylinder, and a locking oil cylinder; the pendulum base is fixed on the baseplate assembly; the swing block is hingedly connected to the pendulum base; the swing block is driven by the swinging oil cylinder to rotate around the pendulum base by using a shaft, so as to achieve entire folding and placing, thereby facilitating transportation; one side of the pendulum is mounted with the locking oil cylinder which locks the swinging manipulator; the swinging manipulator is connected to the pendulum by using a swing shaft; the swing shaft is provided with a primary sprocket; a pulling oil cylinder and a first-stage sprocket are provided within the swinging manipulator; the primary sprocket and a chain on the first-stage sprocket are driven by the pulling oil cylinder, so that the swinging manipulator is enabled to rotate around the pendulum; an arm of the swinging manipulator is mounted with a chain tensioning device, so as to tension the chain; the flexible manipulator is hingedly connected to a shaft at which a top end of the swinging manipulator is located, and a shaft end of the shaft is provided with a second-stage sprocket; the first-stage sprocket and the second-stage sprocket are connected by using a second-stage chain; the flexible manipulator is driven by the second-stage chain on the second-stage sprocket to rotate around the shaft together with the swinging manipulator; a difference between rotation angles of the two manipulators is kept 90° C. by using number of sprocket teeth; the flexible manipulator is connected with a fixing rod; the fixing rod is hingedly connected with four grippers; the flexible manipulator is further provided with a gripper oil cylinder and a rack which are connected to each other; the rack is connected to the four grippers at the same time; the four grippers are driven by the gripper oil cylinder through the rack, so as to make sure synchronism of the four grippers; the flexible manipulator is mounted with an elevating oil cylinder which is connected to the fixing rod through a combination of an elevating shaft sleeve; and when the grippers grab the oil pipe, the elevating oil cylinder may elevate the grippers and the oil pipe by using the combination of the elevating shaft sleeve.

Compared with the prior art, the present invention has the following beneficial effects: a baseplate; the baseplate being mounted with a flatcar up-down adjustment device and a self-locking hydraulic leg which is often used by a conventional construction vehicle; a silo body may grab, within the silo body, a two-dimensional calandria manipulator of a sucker rod of an oil pipe, a random-folding type traveling block rigid guide device; a guide-roller type elevator; a truck-mounted folding type oil pipe manipulator; a detecting and conveying device; a transfer device; a hydraulic system, an electric system; and the external being provided with a slip. The baseplate is skid-mounted, is supported by four hydraulic legs, and may be shipped by a trailer. When working, an acting area to the ground is increased, and adaptability of a device to various geologies is enhanced.

The truck-mounted folding type oil pipe manipulator is located on the skid-mounted baseplate, and may be placed within the skid-mounted baseplate when being folded. When working, the manipulator firmly grasps the oil pipe, so as to achieve conversion of the oil pipe between a horizontal status to a vertical wellhead status. The manipulator is axially fine adjusted, so as to achieve a flexible joint of a screw thread of a well casing, and effectively protect threads of a sucker rod of the well casing.

The random-folding type traveling block rigid guide device is located on the skid-mounted baseplate, and may be placed within the skid-mounted baseplate when being folded. Both the guide-roller type elevator and the hydraulic pipe tongs are mounted on a rigid guide rail. The random-folding type traveling block rigid guide device is vertical to the wellhead when working, so as to provide a rigid rail for the guide-roller type elevator, thereby effectively avoiding influences of an elevator on ascending and descending of the sucker rod of the oil pipe and upper and lower buckles of the sucker rod of the oil pipe because of natural factors. After the oil pipe is grasped by the guide-roller type elevator, ascending and descending of the guide-roller type elevator is achieved by a lifting hook on the workover rig, so as to achieve ascending and descending of the oil pipe. The slip is connected to the wellhead, and achieves clamping and loosening of the oil pipe through locking an opening of an oil cylinder.

The present invention cooperates with the existing workover rig to achieve automation of workover operations of the existing workover rig during the processes of fastening and unfastening the oil pipe for workover, so that pollution is reduced, labor intensity of workers is lowered, and the production efficiency and safety are improved.

BRIEF DESCRIPTION OF THE DRAWINGS

FIG. 18-1 is a front view of a pendulum;

FIG. 18-2 is a top view of FIG. 18-1;

FIG. 18-3 is a front view of a boom;

FIG. 18-4 is a left view of FIG. 18-3;

FIG. 18-5 is a front view of a flexible manipulator;

FIG. 18-6 is a top view of FIG. 18-5;

Figure 1:
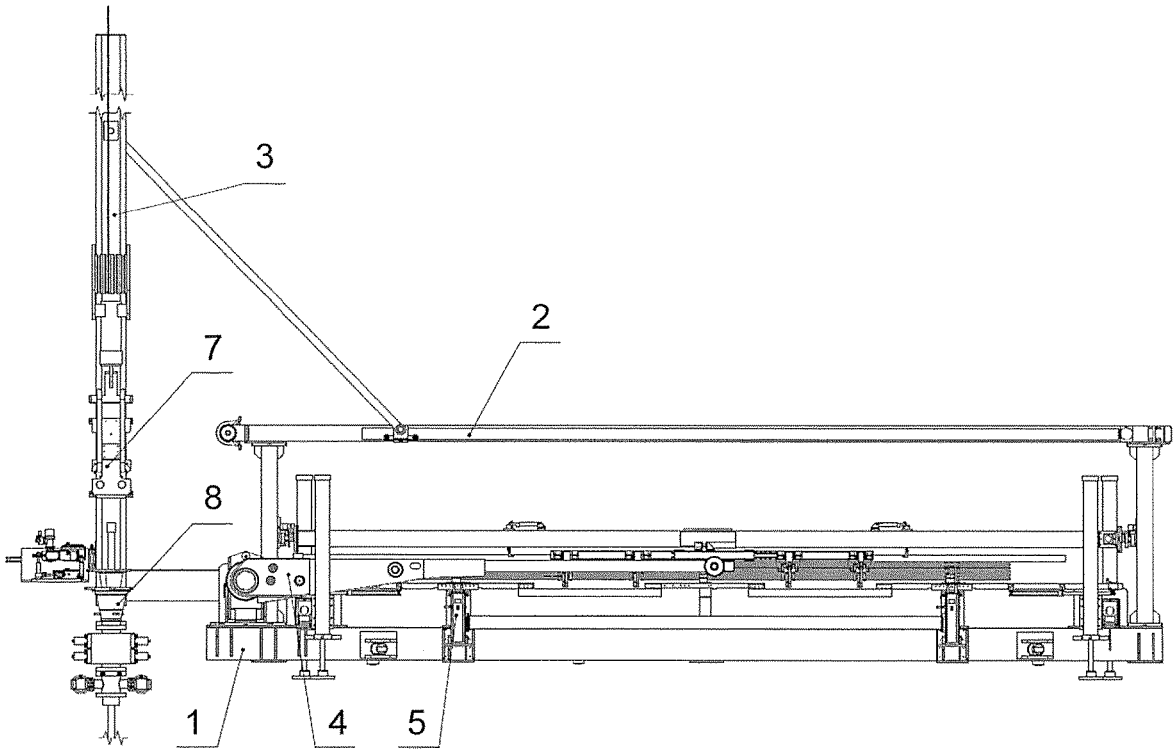
FIG. 1 is a front view of an automatic auxiliary workover rig which is in a working state according to the present invention.
Figure 2:
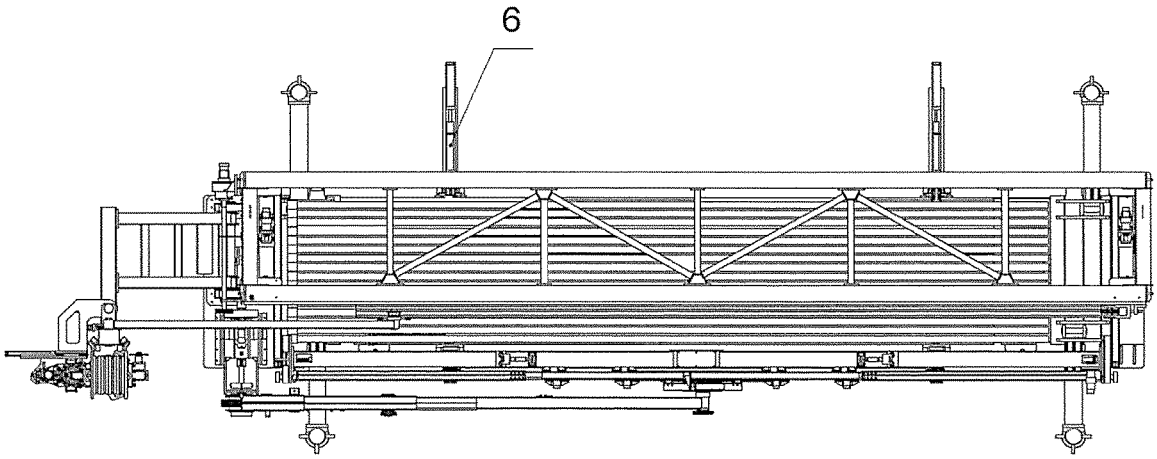
FIG. 2 is a top view of FIG. 1.
Figure 3:
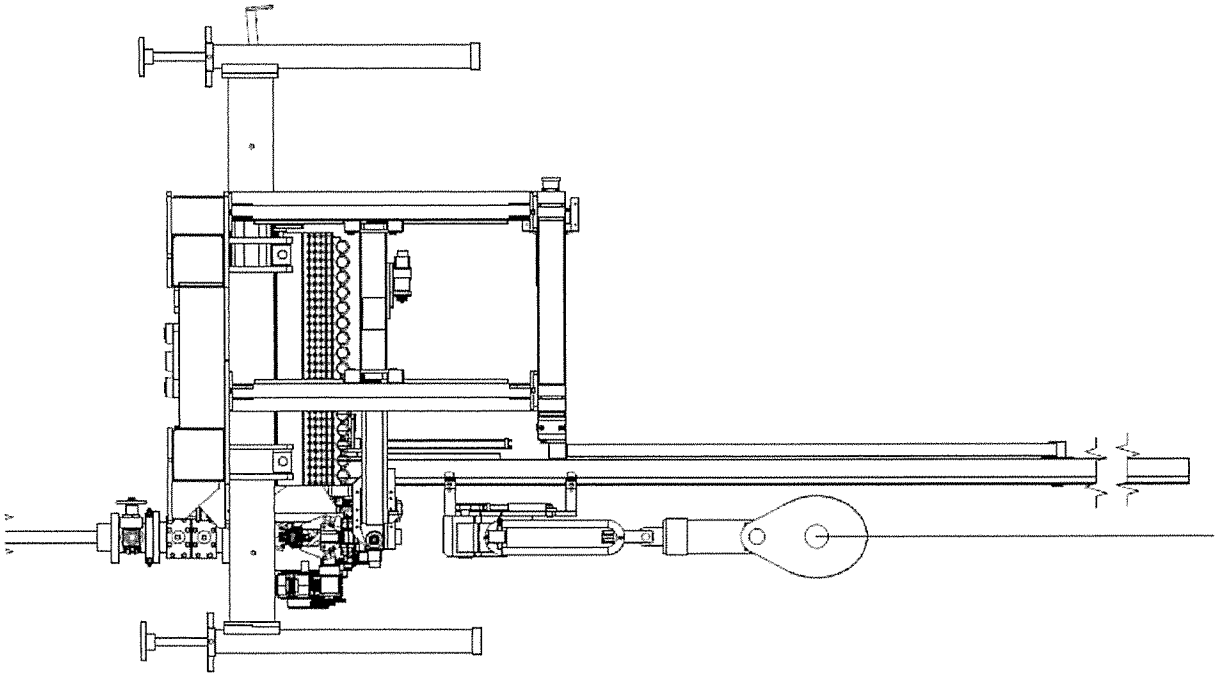
FIG. 3 is a left view of FIG. 1.
Figure 4:
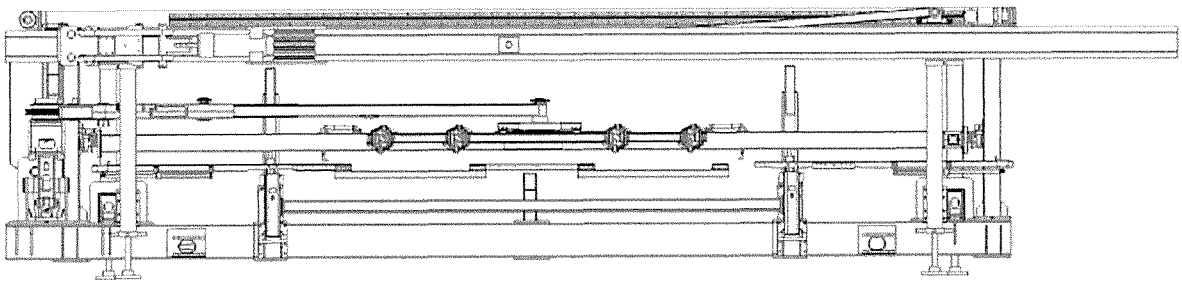
FIG. 4 is a front view of the automatic auxiliary workover rig during a transporting state when being folded according to the present invention.
Figure 5:
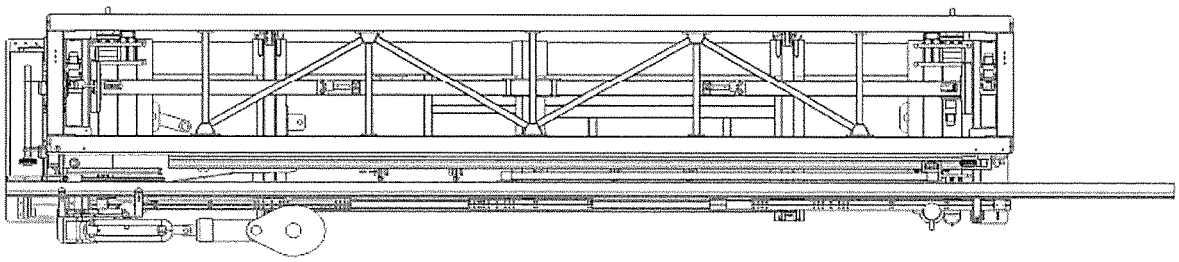
FIG. 5 is a top view of FIG. 4.
Figure 6:
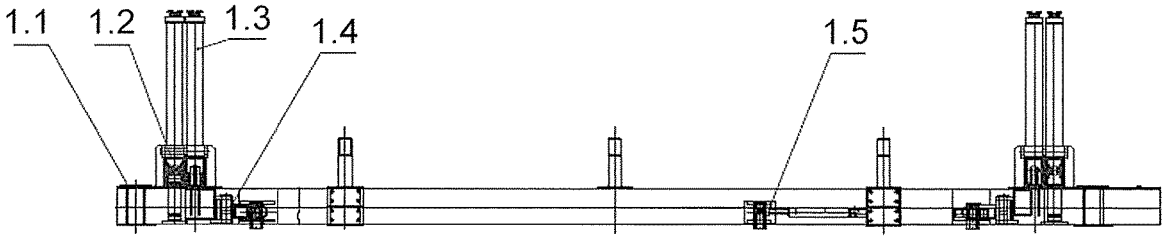
FIG. 6 is a front view of a baseplate.
Figure 7:
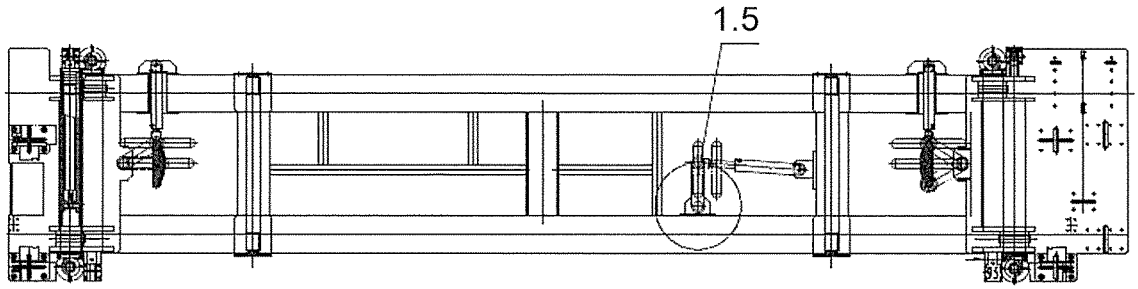
FIG. 7 is a top view of a baseplate.
Figure 8:
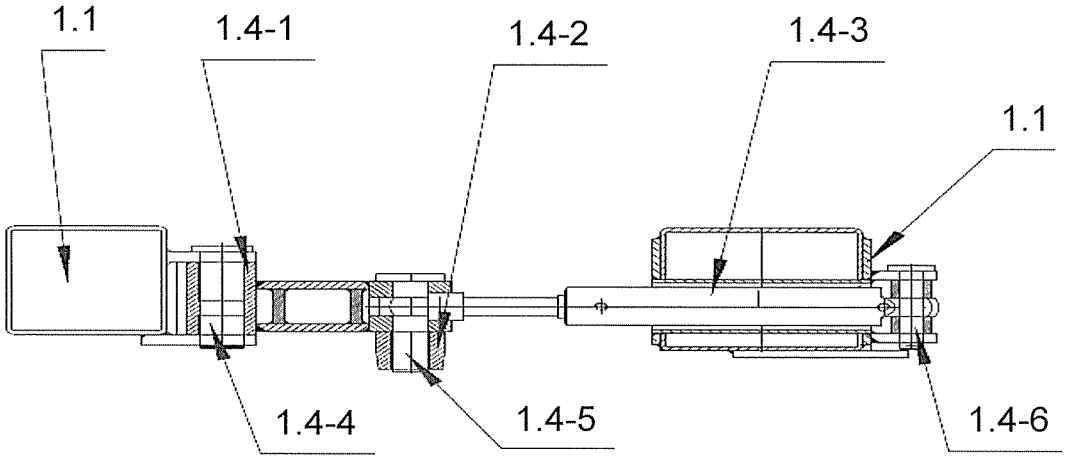
FIG. 8 is a left-right fine-tuning device of a baseplate.
Figure 9:
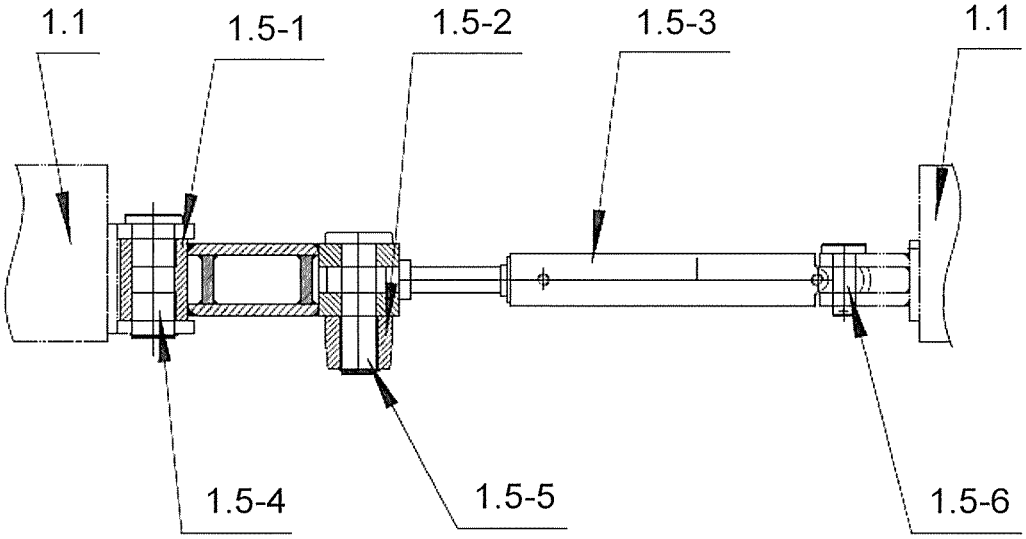
FIG. 9 is a front-rear fine-tuning device of a baseplate.
Figure 10:
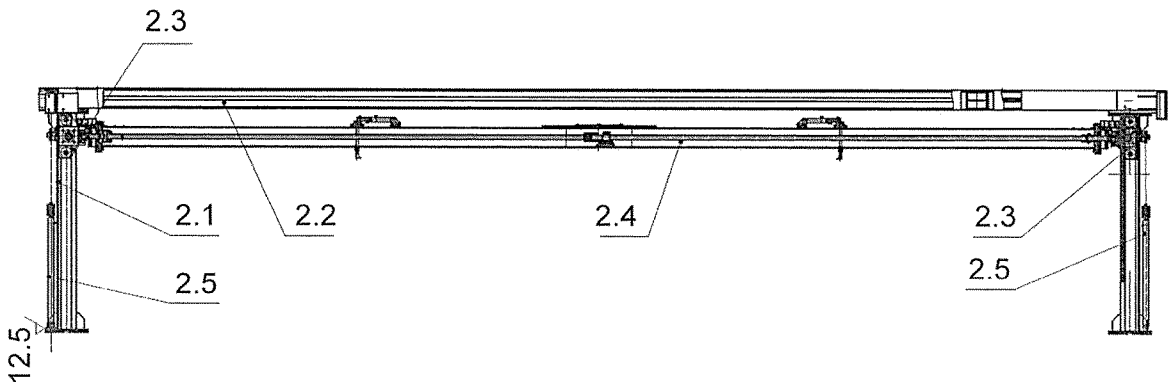
FIG. 10 is a front view of a silo body.
Figure 11:
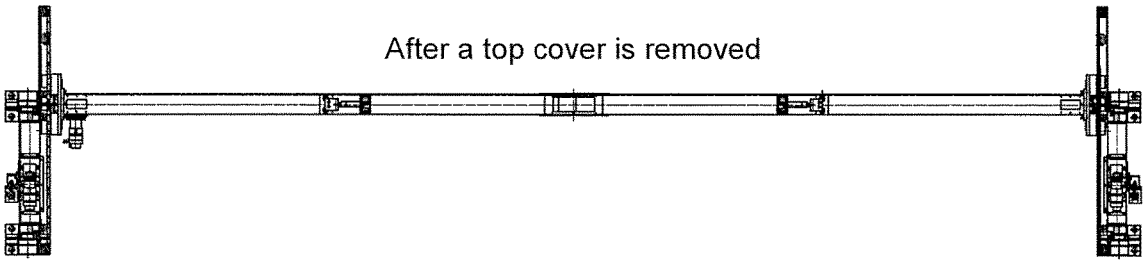
FIG. 11 is a top view of FIG. 10 with an upper connection cap being removed.
Figure 12:
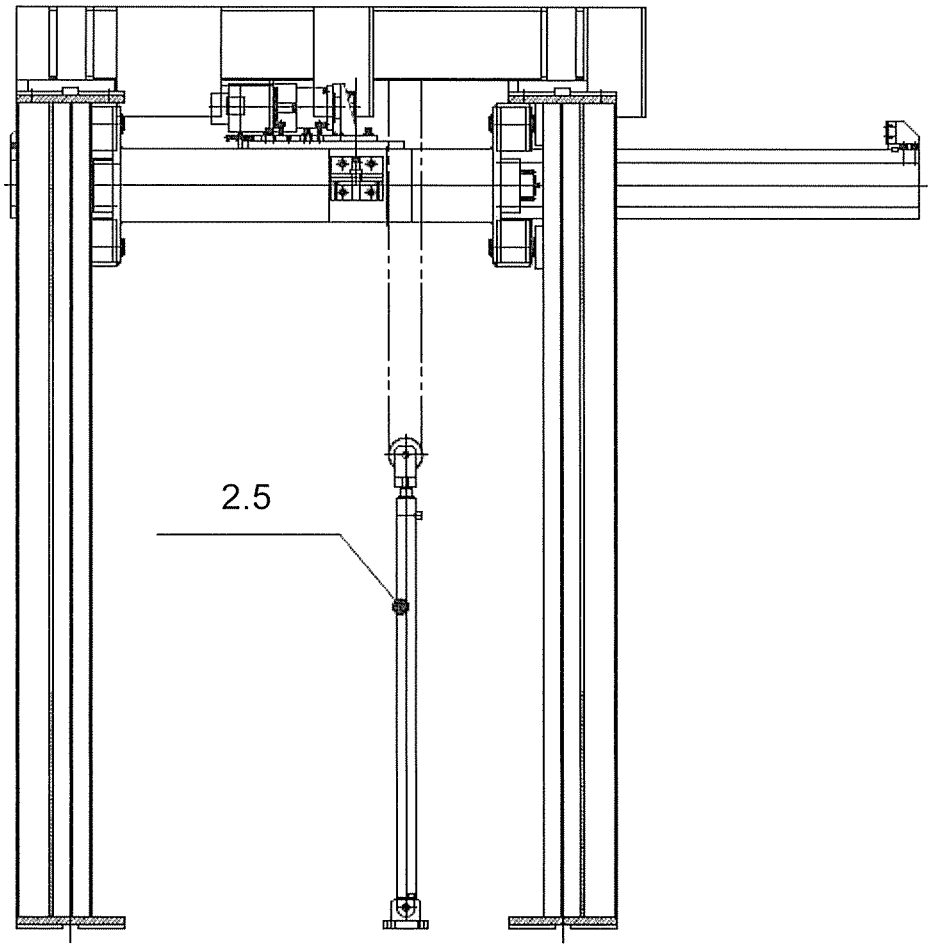
FIG. 12 is a right view of FIG. 11.
Figure 13:
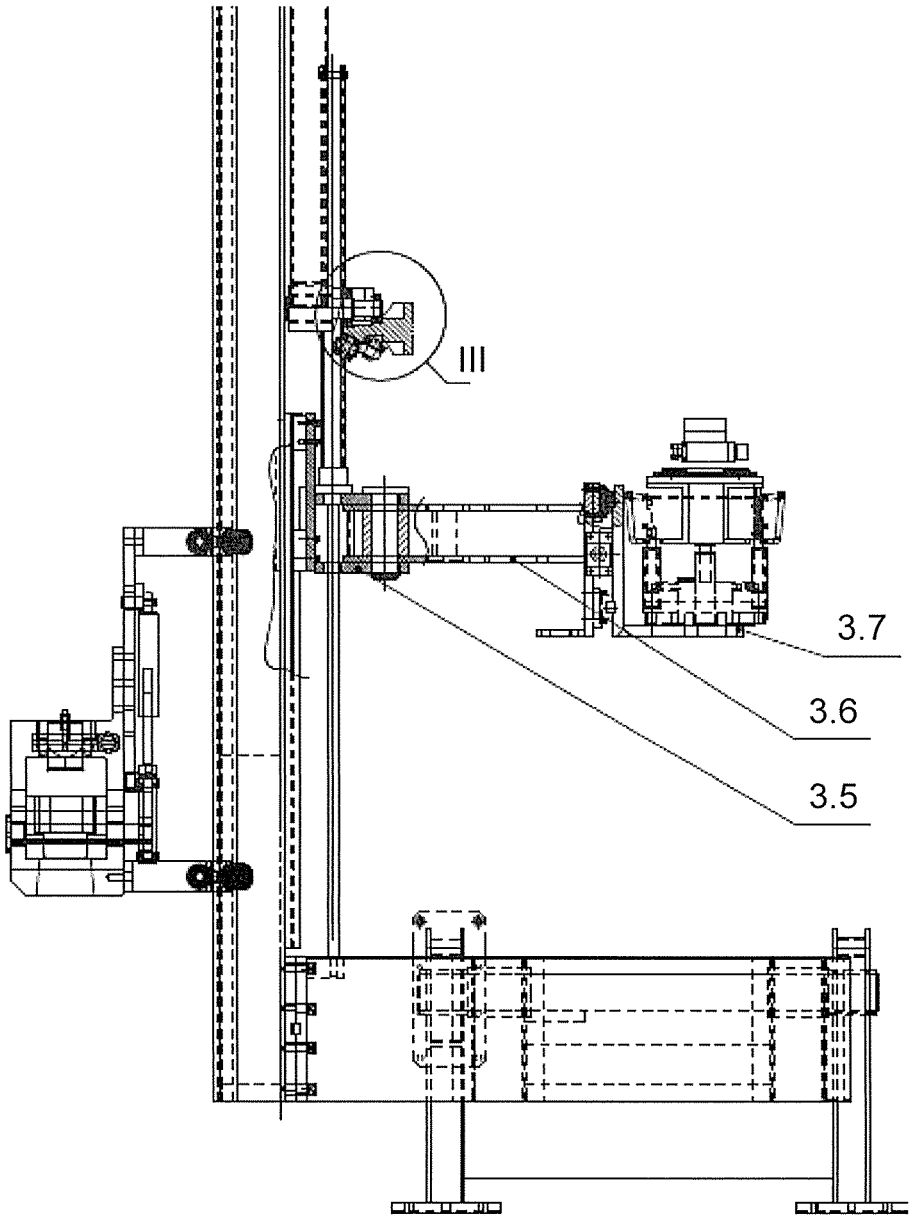
FIG. 13 is a front view of a random-folding type traveling block rigid guide device.
Figure 14:
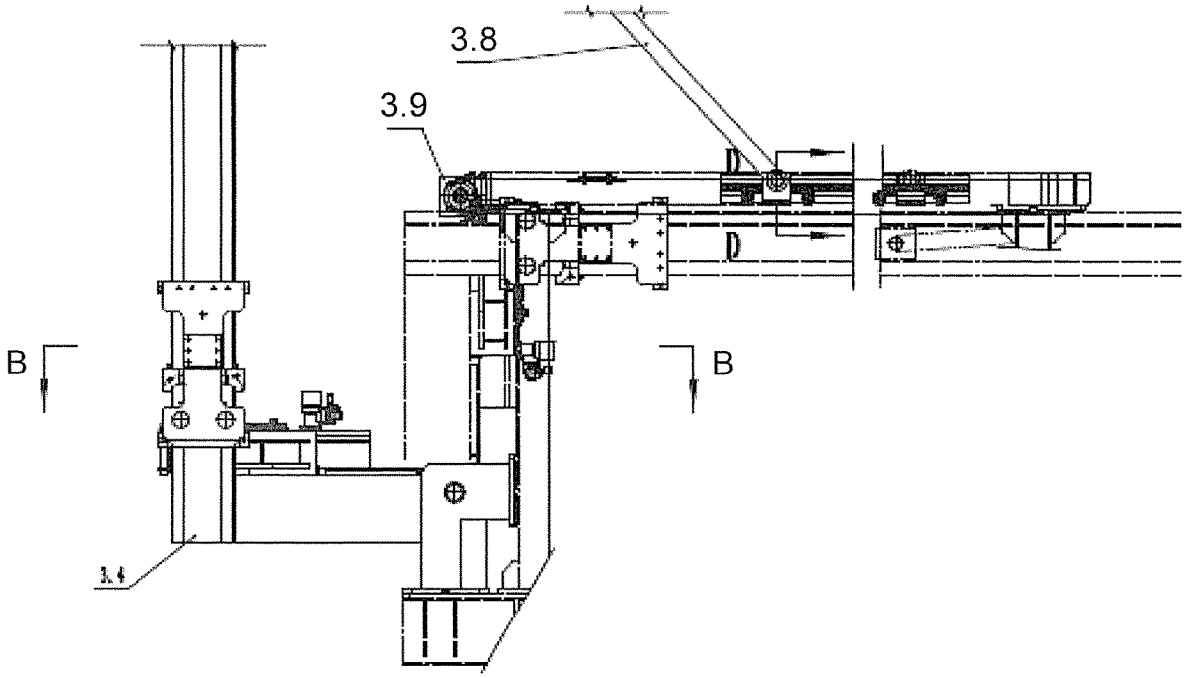
FIG. 14 is a left view of FIG. 13.
Figure 15:
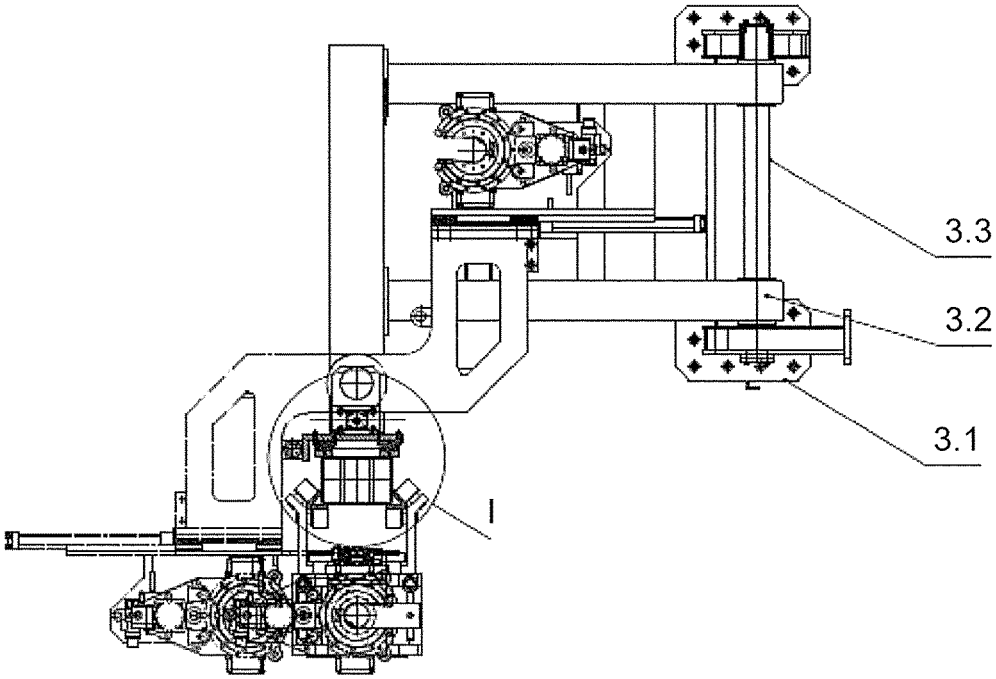
FIG. 15 is a cross-sectional view of B-B on FIG. 14.
Figure 16:
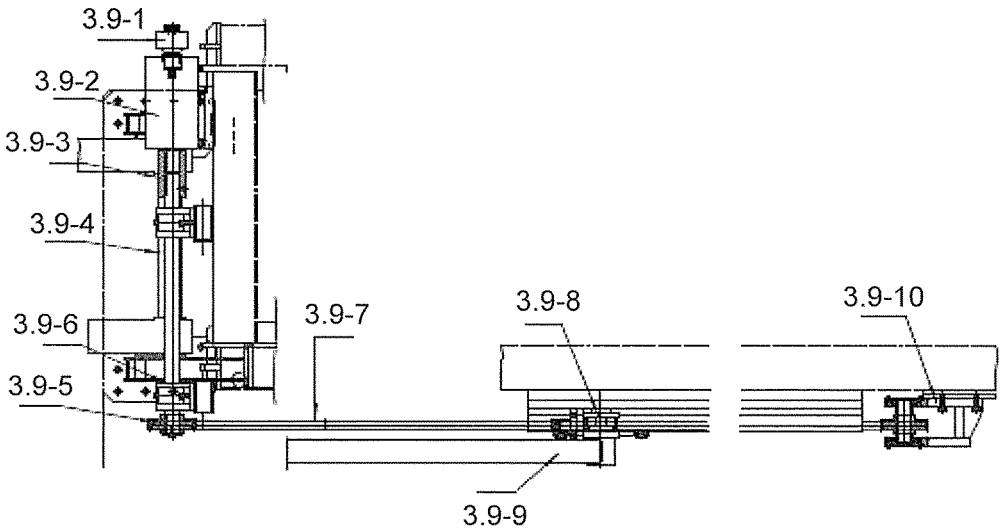
FIG. 16 is a driving view of a random-folding type traveling block rigid guide device.
Figure 17:
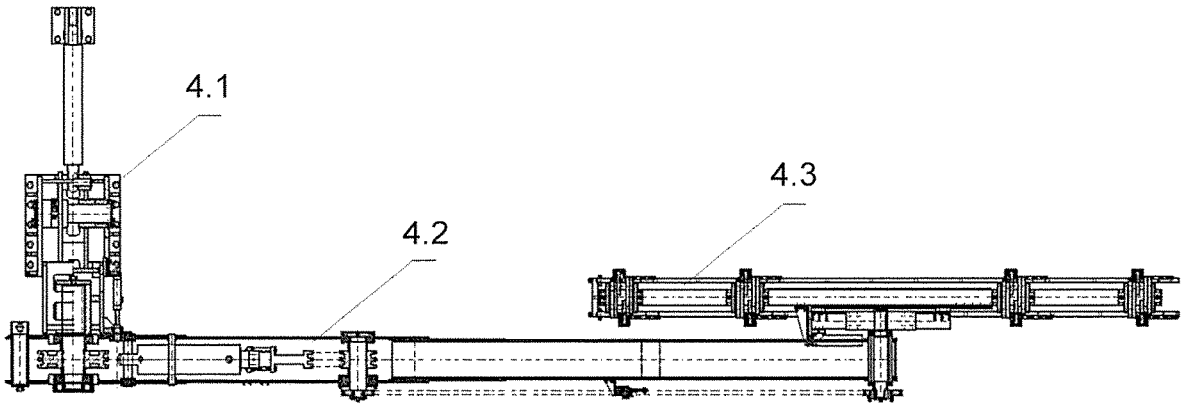
FIG. 17 is a front view of a truck-mounted folding type oil pipe manipulator.
Figure 18:
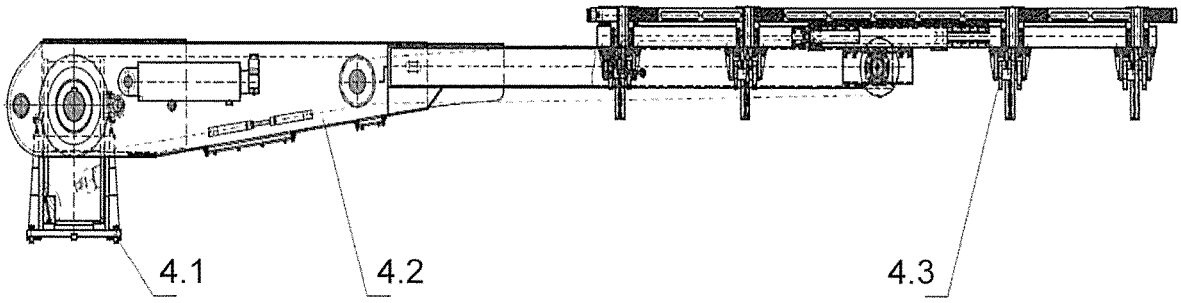
FIG. 18 is a top view of FIG. 17.
Figures 1, 18:
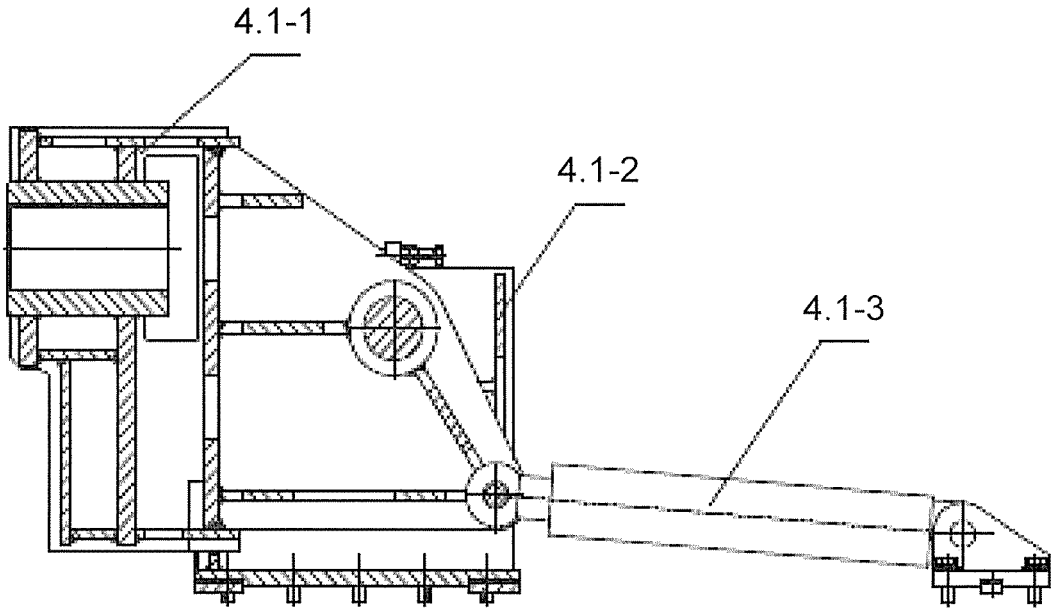
Figures 2, 18:
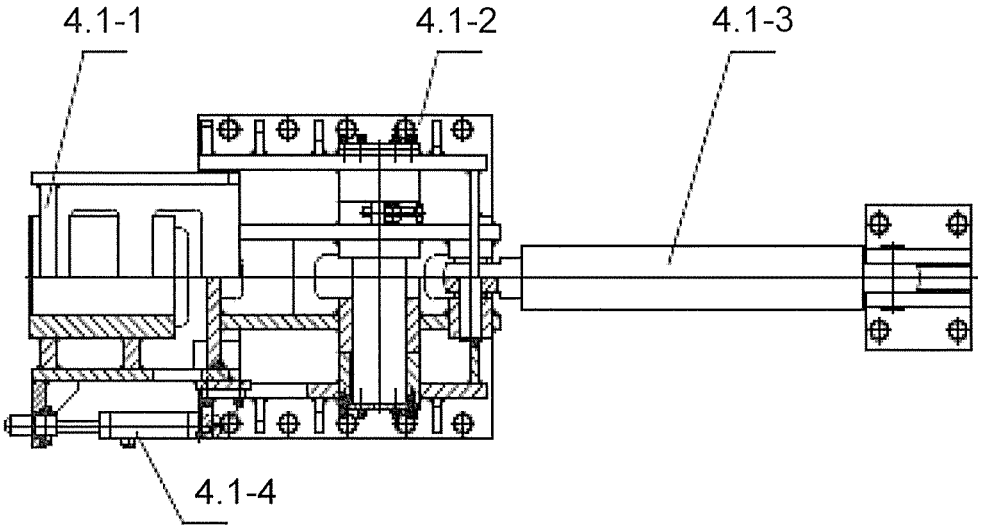
Figures 3, 18:
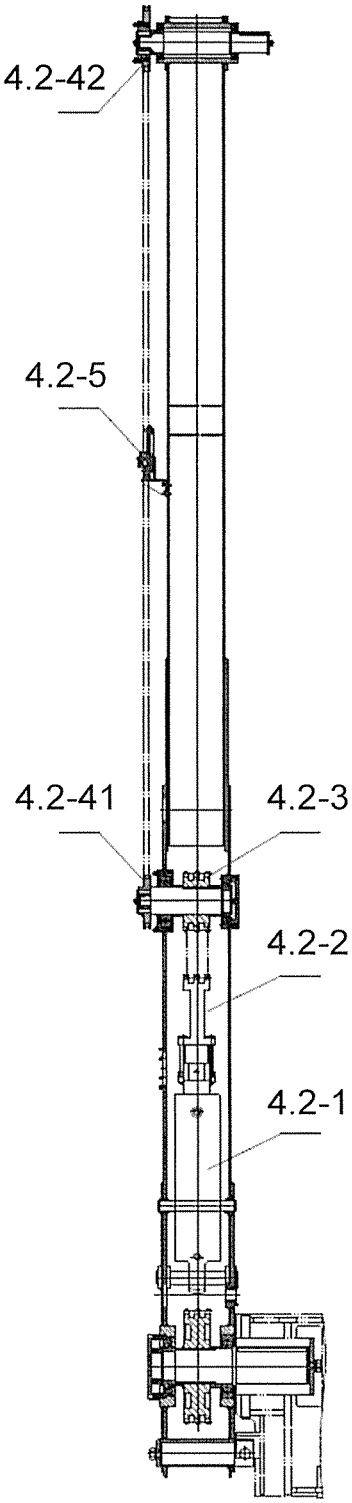
Figures 4, 18:
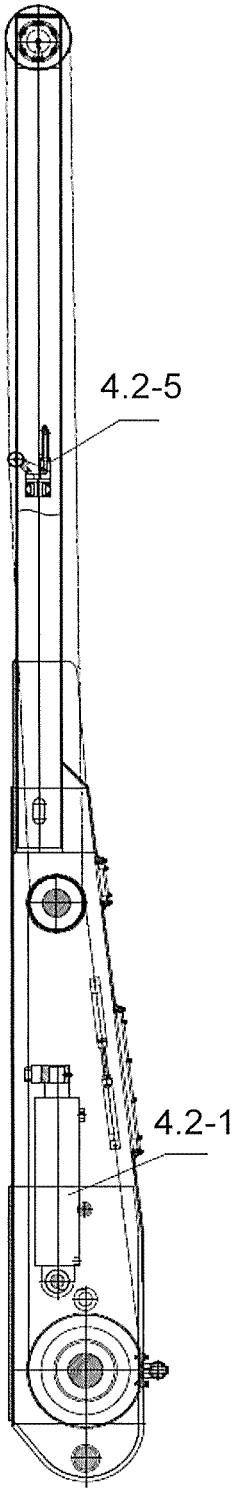
Figures 5, 18:
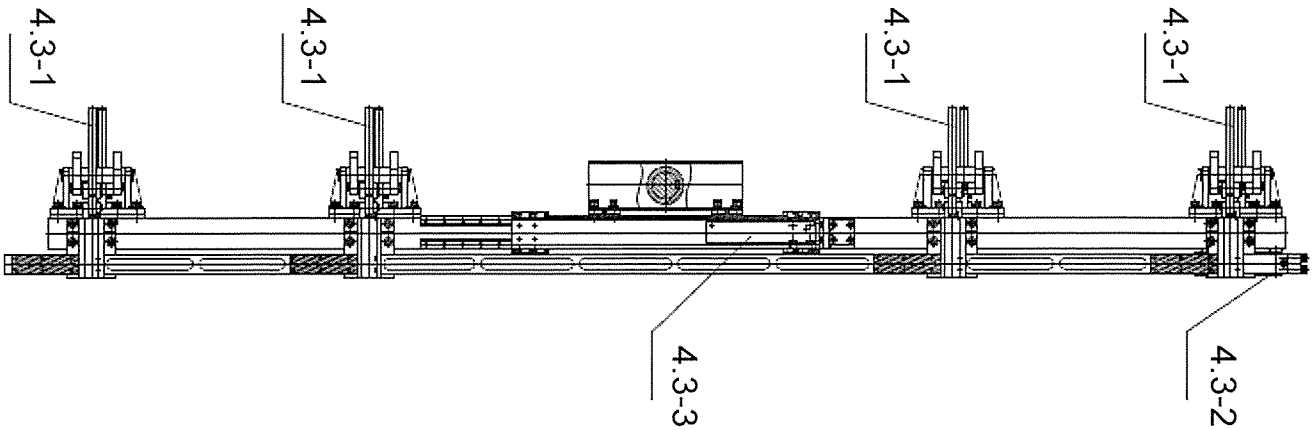
Figures 6, 18:
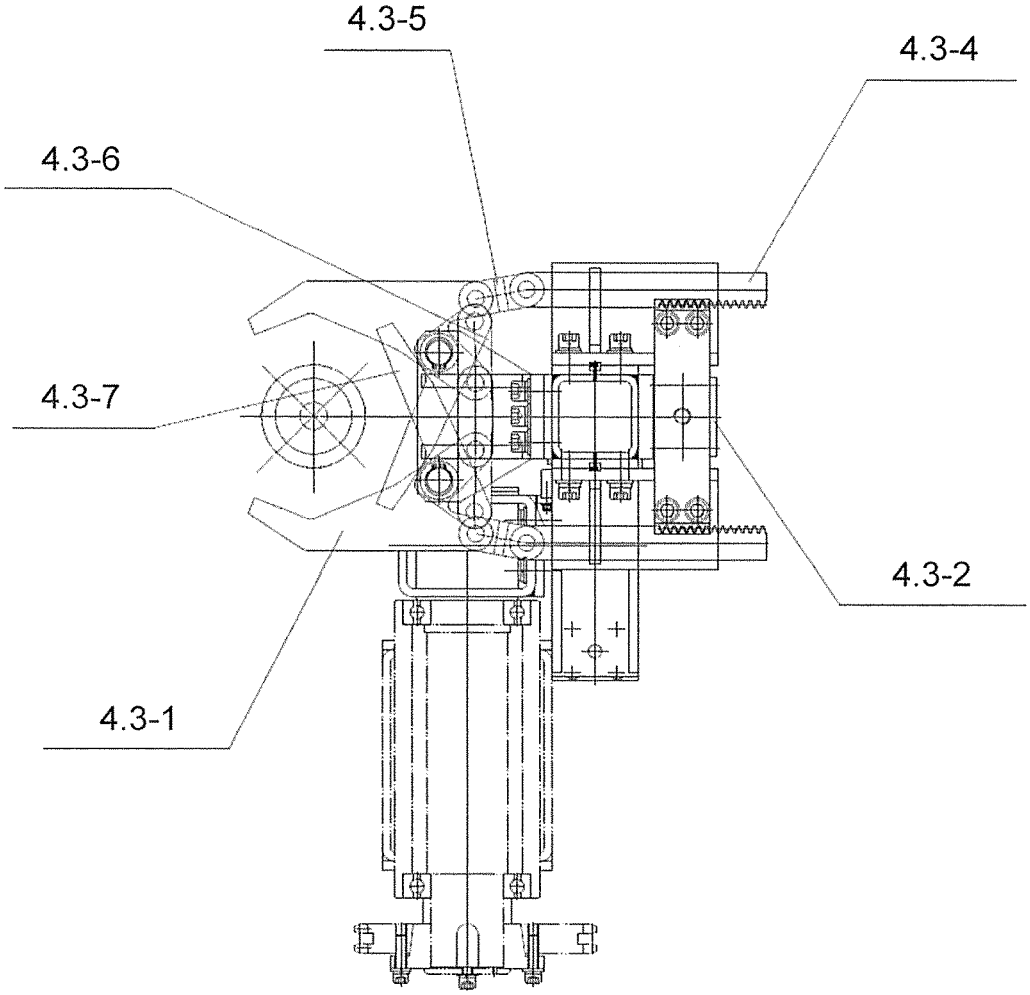
Figure 19:
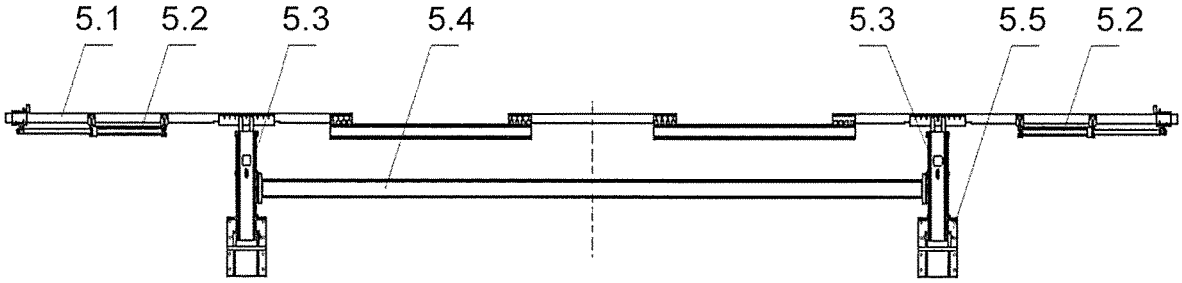
FIG. 19 is a front view of a detecting and conveying device.
Figure 20:
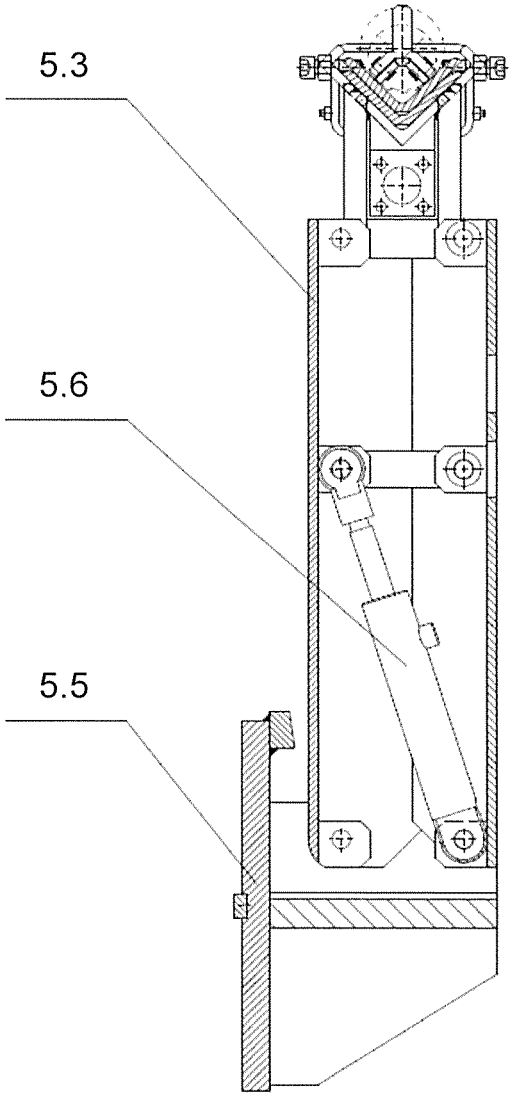
FIG. 20 is a left view of FIG. 19.
Figure 21:
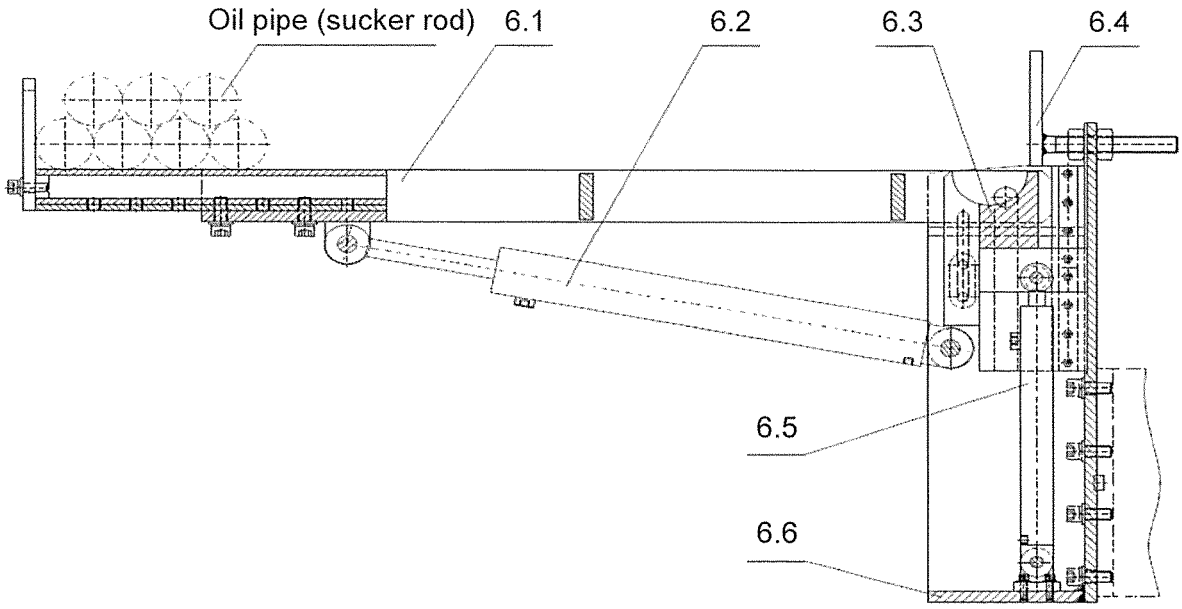
FIG. 21 is a front view of a transfer device.
Figure 22:
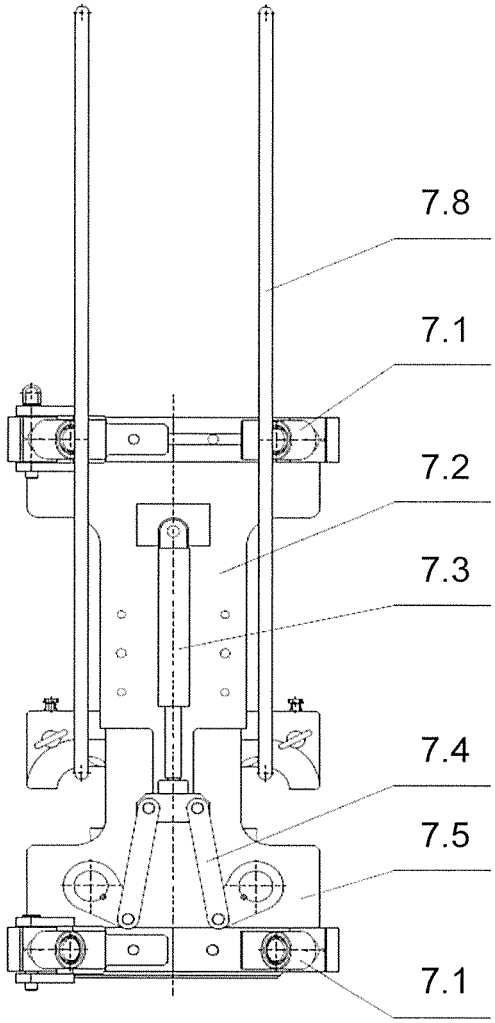
FIG. 22 is a front view of a guide-roller type elevator.
Figure 23:
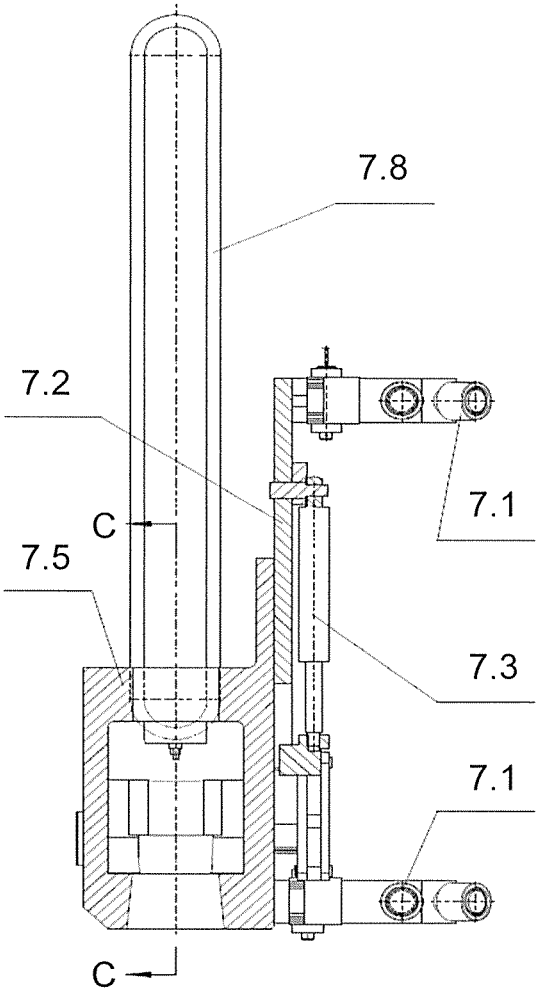
FIG. 23 is a left view of FIG. 22.
Figure 24:
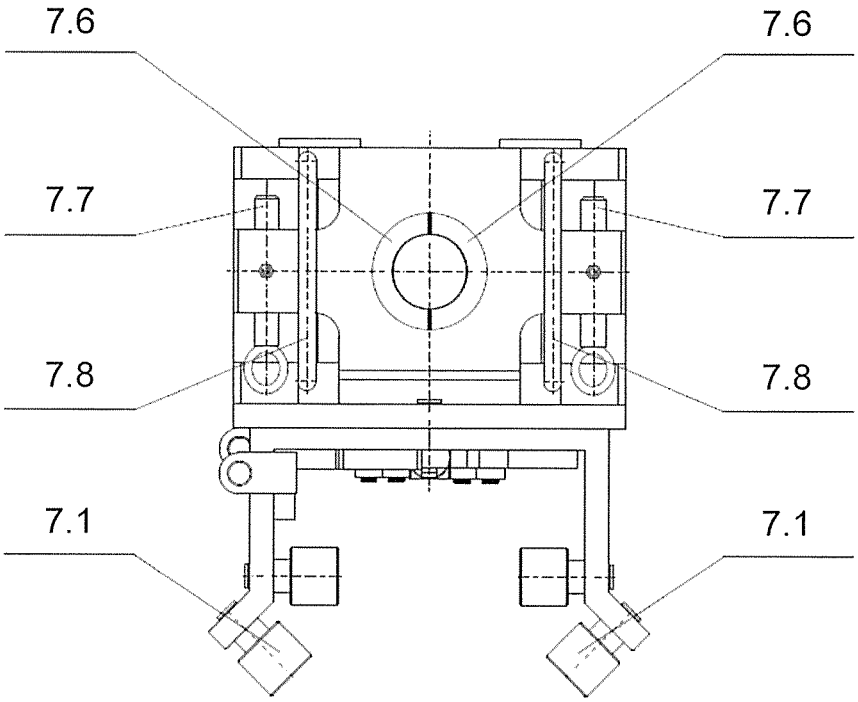
FIG. 24 is a top view of FIG. 22.
Figure 25:
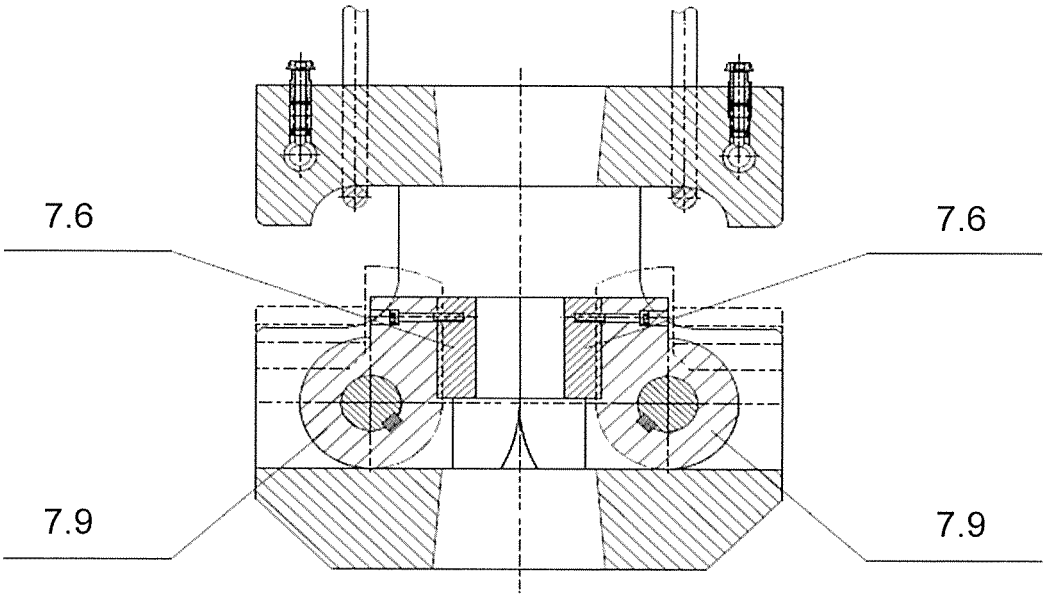
FIG. 25 is a cross-sectional view of C-C of FIG. 23.

In the figures: 1 baseplate assembly; 2 silo body; 3 random-folding type traveling block rigid guide device; 4 truck-mounted folding type oil pipe manipulator; 5 detecting and conveying device; 6 transfer device; 7 guide-roller type elevator; 8 slip; 1.1 baseplate; 1.2 ram; 1.3 hydraulic leg; 1.4 left-right adjustment device; 1.4-1 push rod; 1.4-2 shaft sleeve; 1.4-3 oil cylinder; 1.4-4 shaft I; 1.4-5 shaft II; 1.4-6 shaft III; 1.5 front-rear adjustment device; 1.5-1 push rod; 1.5-2 shaft sleeve; 1.5-3 oil cylinder; 1.5-4 shaft I; 1.5-5 shaft II; 1.5-6 shaft III; 2.1 vertical guide rail; 2.2 upper connection cap; 2.3 horizontal guide rail; 2.4 palletizing manipulator; 2.5 balancing device; 3.1 base; 3.2 pendulum; 3.3 shaft; 3.4 guide rail; 3.5 pipe tongs ascending car; 3.6 pipe tongs pendulum; 3.7 pipe tongs supporting plate; 3.8 pull rod; 3.9 driving device; 3.9-1 hydraulic motor; 3.9-2 decelerator; 3.9-3 coupling; 3.9-4 shaft; 3.9-5 sprocket; 3.9-6 bearing; 3.9-7 chain; 3.9-8 car; 3.9-10 sprocket base; 4.1 pendulum; 4.2 swinging manipulator; 4.3 flexible manipulator, 4.1-1 swing block; 4.1-2 pendulum base; 4.1-3 swinging oil cylinder; 4.2-1 pulling oil cylinder; 4.2-2 link header; 4.2-3 first-stage inner sprocket; 4.2-41 first-stage outside sprocket; 4.2-42 second-stage sprocket; 4.2-5 chain tensioning device; 4.3-1 external gripper; 4.3-2 rack; 4.3-3 rack oil cylinder; 4.3-4 first connecting rod; 4.3-5 second connecting rod; 4.3-6 fourth connecting rod; 4.3-7 internal gripper; 5.1 swing frame; 5.2 length measuring oil cylinder; 5.3 swing arm; 5.4 cross beam; 5.5 base; 5.6 swinging oil cylinder; swing arm 6.1; swinging oil cylinder 6.2; ejecting slide block 6.3; adjustment push plate 6.4; lifting oil cylinder 6.5; base 6.6; 7.1 guide pulley; 7.2 guide plate; 7.3 oil cylinder; 7.4 push rod; 7.5 elevator body; 7.6 latching block; 7.7 pin shaft; 7.8 suspension ring.

DESCRIPTION OF THE EMBODIMENTS

Detailed description and technical content about the present invention are described below with reference to the accompanying drawings. However, the accompanying drawings only provide reference and descriptions, and are not intended to limit the present invention.

According to all the accompanying drawings, an automatic auxiliary workover rig is provided, including a baseplate assembly 1, a silo, a random-folding type traveling block rigid guide device 3, a guide-roller type elevator 7, a truck-mounted folding type oil pipe manipulator 4, a detecting and conveying device 5, and a transfer device 6. The folding type traveling block rigid guide device is hingedly connected to a rear end of the baseplate assembly. The guide-roller type elevator is mounted on the folding type traveling block rigid guide device. A portion at the bottom of the truck-mounted folding type oil pipe manipulator is also hingedly connected to the rear end of the baseplate assembly and operates between the detecting and conveying device and the guide-roller type elevator. The silo is mainly a silo body 2 and is provided on a baseplate. The transfer device used in cooperation with the silo to be responsible for leading in and out of an oil pipe is located at a left side of the silo and is provided on the baseplate assembly, and the detecting and conveying device used in cooperation with the silo and having functions of detection, positioning, and transferring is located at a right side of the silo and is further provided on the baseplate assembly. The baseplate assembly includes a baseplate 1.1, rams 1.2, and hydraulic legs 1.3. There are four hydraulic legs which are provided nearby four corners at two sides of the baseplate, so as to support the baseplate, and the hydraulic legs are connected to the rams. The rams are connected to the baseplate by using respective hydraulic cylinders to which the rams are connected.

The random-folding type traveling block rigid guide device includes a retractable guide device and a guide rail driving device 3.9. The retractable guide device includes a guide rail 3.4, a hydraulic pipe tongs swiveling device, and a base. A bottom portion of the guide rail is hingedly connected to the base. The base is connected to the baseplate assembly. Both the guide-roller type elevator and the hydraulic pipe tongs swiveling device are mounted on the guide rail. The guide rail driving device includes a hydraulic motor 3.9-1, a pull rod 3.8, a sliding car 3.9-8, a decelerator 3.9-2, a transmission shaft 3.9-4, and a sprocket 3.9-5. Two ends of a top portion of the silo body are respectively provided with a sprocket to be connected by a chain. The sliding car is provided on the chain. One end of the pull rod is hingedly connected to the sliding car, and the other end is hingedly connected to the guide rail. The hydraulic motor is connected to and drives the sprocket located at a beginning end by using the decelerator and the transmission shaft. The hydraulic pipe tongs swiveling device includes a hydraulic pipe tongs, a pipe tongs pendulum 3.6, and a pipe tongs ascending car 3.5. The hydraulic pipe tongs is connected to the pipe tongs pendulum by using a pipe tongs supporting plate 3.7, and the pipe tongs pendulum is connected in a sliding manner to the guide rail by using the pipe tongs ascending car.

The automatic auxiliary workover rig further includes a flatcar up-down adjustment device which includes a left-right adjustment device 1.4 and a front-rear adjustment device 1.5. The left-right adjustment device is mounted at a position near a rear section of the baseplate in a left-right direction, and includes a push rod 1.4-1 and an oil cylinder 1.4-3. One end of the push rod is hingedly connected to the baseplate, and the other end is hingedly connected to an earring at a cylinder head of the oil cylinder, where a position at which the push rod and the baseplate are hingedly connected is inserted into a rectangular groove of a trailer by using a shaft 1.4-5. Moreover, an earring at a cylinder bottom of the oil cylinder is hingedly connected to the baseplate. When the oil cylinder pushes, a shaft at the position at which the push rod and the baseplate are hingedly connected moves in the groove of the trailer. Because the trailer stops on the ground and does not move, according to the principle of relative motion, the oil cylinder pushes the baseplate to move by using the push rod and a body of the oil cylinder. The front-rear adjustment device is mounted at a position near a front section of the baseplate in a front-rear direction, and has a same structure as that of the left-right adjustment device.

The silo body may temporarily store some sucker rods of the oil pipe, and an internal of the silo body includes a two-dimensional palletizing manipulator 2.4 which can connect the oil pipe from internal and external of the silo body. The palletizing manipulator is mounted on a horizontal guide rail 2.3, and two ends of the horizontal guide rail are mounted on a vertical guide rail 2.1. The palletizing manipulator grabs the oil pipe as left-right and up-down movements of as the horizontal guide rail and the vertical guide rail. The vertical guide rail is fixed on the silo body, and a top portion of the silo body is provided with an upper connection cap 2.2. Two sides of the silo body are provided with a balancing device 2.5 connected to the vertical guide rail.

The detecting and conveying device includes a swing frame 5.1, a length measuring oil cylinder 5.2, conveying swing arms 5.3, a cross beam 5.4, a base 5.5, and swinging oil cylinders 5.6. The swing frame is mounted on the conveying swing arms for connecting and placing the oil pipe. The length measuring oil cylinder is mounted below the swing frame. The oil pipe is positioned through shrinkage and extension of the length measuring oil cylinder, so that a length of the oil pipe is able to be measured by using a linear encoder to calculate the shrinkage and extension of the length measuring oil cylinder. There are two conveying swing arms which are provided at the front and the rear, and the two swing arms are connected by a cross beam so as to be synchronous. Swinging oil cylinders are provided within the conveying swing arms, and the swinging oil cylinders are respectively hingedly connected to the base and the conveying swing arms, and are driven to swing around the base due to a swinging of the oil pipe, so as to lead the oil pipe into and out from the silo. The base is further connected to the baseplate assembly and is at a right side of the silo, i.e., being at a same side with the truck-mounted folding type oil pipe manipulator. A central axis of the swinging oil cylinders is inclined with respect to a horizontal line, and an inclination angle is greater than 0° C. and less than 90° C.

The transfer device includes a transferring swing arm 6.1, a swinging oil cylinder 6.2, an ejecting slide block 6.3, an adjustment push plate 6.4, a lifting oil cylinder 6.5, and a base 6.6. The base is fixed at a side of the silo that is far away from a wellhead. A front end of the swinging oil cylinder is hingedly connected to a bottom portion at a front end of the transferring swing arm, and a rear end is hingedly connected to the base. The ejecting slide block is provided at an upper end of the base and at right behind of the transferring swing arm. The lifting oil cylinder is provided below the slide block. The adjustment push plate is provided at a right side of the ejecting slide block, and the adjustment push plate includes a push plate and an adjusting bolt at a back surface of the push plate.

The guide-roller type elevator includes a guide pulley 7.1, a guide plate 7.2, an elevator oil cylinder 7.3, a push rod 7.4, an elevator body 7.5, a holding sleeve 7.6, a pin shaft 7.7, a suspension ring 7.8, and a swing block 7.9. The guide pulley is fixed on the guide plate, and moves up and down along the guide rail, thereby achieving rigid guide of the guide-roller type elevator. The guide plate is fixed on the elevator body, and a center of the elevator body is provided with the holding sleeve which is longitudinally disposed. The swing block is hingedly connected within the elevator and at two sides of the holding sleeve. The oil pipe passing through a sleeve is clamped or loosened through rotation of the swing block. The guide plate is provided with the elevator oil cylinder which is connected to the push rod. A lower end of the push rod is hingedly connected to the swing block. The holding sleeve is driven by to clamp or loosen a pipe ferrule of the oil pipe as the swing block is driven by the elevator oil cylinder into rotation.

The truck-mounted folding type oil pipe manipulator includes a pendulum 4.1, a swinging manipulator 4.2, and a flexible manipulator 4.3. The pendulum includes a swing block 4.1-1, a pendulum base 4.1-2, a swinging oil cylinder 4.1-3, and a locking oil cylinder 4.1-4. The pendulum base is fixed on the baseplate assembly. The swing block is hingedly connected to the pendulum base, and is driven by the swinging oil cylinder to rotate around the pendulum base, so as to achieve entire folding and placing, thereby facilitating transportation. One side of the pendulum is mounted with the locking oil cylinder which locks the swinging manipulator. The swinging manipulator is connected to the pendulum by using a swing shaft which is provided with a primary sprocket. A pulling oil cylinder 4.2-1 and a first-stage inner sprocket 4.2-3 are provided within the swinging manipulator. The primary sprocket and a chain on the first-stage inner sprocket are driven by the pulling oil cylinder, so that the swinging manipulator is enabled to rotate around the pendulum. An arm of the swinging manipulator is mounted with a chain tensioning device 4.2-5, so as to tension the chain. The flexible manipulator 4.3 is hingedly connected to a shaft at which a top end of the swinging manipulator 4.2 is located, and a shaft end of the shaft is provided with a first-stage outer sprocket 4.2-41, and a top end of the flexible manipulator is provided with a second-stage sprocket 4.2-42, where the first-stage outer sprocket and the second-stage sprocket are connected by using a second-stage chain. The flexible manipulator is driven by the second-stage chain on the second-stage sprocket to rotate around the shaft together with the swinging manipulator. A difference between rotation angles of the two manipulators is kept 90° C. by using number of sprocket teeth. The flexible manipulator is connected with a fixing rod, and the fixing rod is hingedly connected with four grippers. The flexible manipulator is further provided with a gripper oil cylinder and a rack which are connected to each other. The rack is connected to the four grippers at the same time. The grippers are divided into external grippers 4.3-1 (a third connecting rod) and internal grippers 4.3-7 (a fifth connecting rod). A link mechanism is formed by a first to the fifth connecting rods. Rack 4.3-2 is an inclined rack. Two connecting rods hingedly connected successively which are provided between the external grippers and the rack are first connecting rod 4.3-4 and second connecting rod 4.3-5, respectively. An inner side of the external grippers is provided with an internal gripper 4.3-7, and a fourth connecting rod 4.3-6 is hingedly connected therebetween. The rack is engaged with a tooth surface of the first connecting rod at a rear side of the external grippers, where the first connecting rod is connected to the second connecting rod by using the pin shaft; the second connecting rod is connected to the external grippers, i.e., the third connecting rod, by using the pin shaft; the third connecting rod is fixed on the fixing rod; a rear end of the third connecting rod is connected to a fourth connecting rod by using the pin shaft; and the fourth connecting rod is connected to the internal grippers fixed on the fixing rod at another side of the rack, i.e., the fifth connecting rod, by using the pin shaft. During a process that the oil cylinder pushes the rack (the rack is an inclined tooth surface) to move along an axial direction, because the rack has an angle, a shift at a horizontal direction may be generated during the axial moving process of the rack, so that the first connecting rod pushes the third connecting rod by using the second connecting rod, and a rear side of the third connecting rod moves along a direction which is reverse to a direction of the third connecting rod by using the fifth connecting rod to which the fourth connecting rod is connected. Therefore, the internal grippers and the external grippers are enabled to be clamped and loosened towards inside centers of the grippers, so as to achieve that the oil pipe is clamped by four points of a group of internal and external grippers at two sides.

This embodiment is used in cooperation with the existing manual workover rig. The baseplate 1.1 is supported by four hydraulic legs 1.3 which are connected to the rams 1.2, where the rams 1.2 are ejected by four horizontal cylinders; and the baseplate may be entirely shipped by the trailer, and may be adjusted by the left-right adjustment device 1.4 and the front-rear adjustment device 1.5 to directly face the wellhead. The palletizing manipulator 2.4 is provided within the silo, where the palletizing manipulator 2.4 grabs the oil pipe as left-right and up-down movements of a horizontal beam 2.3 and a vertical beam 2.1. Two sides of the silo are provided with the balancing device 2.5, so as to balance dead weights of the horizontal and the vertical guide rails. The palletizing manipulator 2.4 mainly palletizes the oil pipe in the silo and places the oil pipe onto the detecting and conveying device 5 or the transfer device 6. The two sides of the silo are the detecting and conveying device 5 and the transfer device 6, separately. The detecting and conveying device 5 is at a side close to the wellhead, and is responsible for measuring length of the oil pipe, positioning, and leading in and out the oil pipe. The transfer device 6 is at another side of the silo, and is responsible for leading in and out the oil pipe.

The random-folding type traveling block rigid guide device 3 is mounted on the baseplate 1.1, and is located at side of the truck-mounted folding type oil pipe manipulator 4 and the wellhead. Both the guide-roller type elevator 7 and the hydraulic pipe tongs are mounted on this device, where the entirety is a rigid device, so as to make sure central positions of the pipe tongs and the guide-roller type elevator 7, thereby effectively avoiding interference on ascending and descending of the oil pipe because of external natural factors. When in a transportation status, the random-folding type traveling block rigid guide device 3 may drive a car 3.9-8 by a hydraulic motor 3.9-1 in a driving device 3.9 by using a decelerator 3.9-2, a coupling 3.9-3, a shaft 3.9-4, a sprocket 3.9-5, and a chain 3.9-7, where the car 3.9-8 pushes the guide rail 3.4 to rotate around the shaft 3.2 by using a connecting rod, and is folded and placed in the baseplate 1, thereby facilitating transportation.

The truck-mounted folding type oil pipe manipulator 4 includes the pendulum 4.1, the swinging manipulator 4.2, and the flexible manipulator 4.3. The pendulum 4.1 is divided into two parts, where one part is fixed at a side of the baseplate 1 that is close to the wellhead, and the other part is driven by the oil cylinder to rotate around the fixed part by using the shaft, so as to achieve entire folding and placing, thereby facilitating transportation. A side of the pendulum 4.1 is mounted with a locking cylinder to lock the swinging manipulator 4.2, where the swinging manipulator 4.2 is connected to the pendulum 4.1 through the shaft. An oil cylinder is mounted within the swinging manipulator 4.2, so as to pull, by using the oil cylinder, the chain to enable the swinging manipulator 4.2 to rotate around the pendulum 4.1. The arm of the swinging manipulator 4.2 is mounted with a chain tensioning device, so as to tension the chain. The flexible manipulator 4.3 is mounted at the top end of the swinging manipulator 4.2, is connected by using the shaft, and is driven by the chain to rotate around the shaft together with the swinging manipulator 4.2. The four grippers of the flexible manipulator 4.3 are driven by an oil cylinder through the rack, so as to make sure synchronism of the four grippers. The flexible manipulator 3 is mounted with an elevating oil cylinder, so as to elevate the grippers and the oil pipe when the grippers grab the oil pipe. The truck-mounted folding type oil pipe manipulator 4 cooperates with the detecting and conveying device 5 and the guide-roller type elevator 7, is responsible for ascending and descending the oil pipe, and may convert the oil pipe in a horizontal status into a vertical status. When in the transportation status, the truck-mounted folding type oil pipe manipulator 4 may drive the pendulum to turn over by using an over-turning oil cylinder, and the pendulum may be folded within the baseplate 1 after turning over, thereby facilitating transportation.

The swing frame 5.1 of the detecting and conveying device 5 is mounted on the swing arms 5.3 for connecting and placing the oil pipe. The length measuring oil cylinder 5.2 is mounted below the swing frame 5.1, the oil pipe is positioned through the shrinkage and extension of the length measuring oil cylinder 5.2, so that the length of the oil pipe is measured by using the linear encoder to calculate the shrinkage and extension of the length measuring oil cylinder. The two swing arms 5.3 are connected by the cross beam 5.4 so as to be synchronous. The swing arms 5.3 are further connected to the base 5.5 by using the shaft, and are driven by the swinging oil cylinders 5.6 to swing around the base 5.5, so as to lead the oil pipe into and out from the silo. When in the transportation status, the oil cylinder is pushed to extend out completely, so that an end surface of the conveying swing arms 5.3 is in contact with the base 5.5, and the conveying swing arms 5.3 drive the swing frame 5.1 to be within a conventional transportation width.

The base 6.6 of the transfer device 6 is fixed at a side of the silo body 2 that is far away from the wellhead. The sucker rods of the oil pipe are placed on the forwarding swing arm 6.1. The forwarding swing arm 6.1 is pushed by the swinging oil cylinder 6.2 to turn over. A distance from a front side to a rear side of the push plate 6.4 is adjusted, so that when the slide block 6.3 is lifted by the lifting oil cylinder 6.5, only one sucker rod of the oil pipe is allowed to be lifted by the slide block 6.3 and the forwarding swing arm 6.1 is pushed by the swinging oil cylinder 6.2 to be in a vertical state when the automatic auxiliary workover rig is transporting.

The guide pulley 7.1 of the guide-roller type elevator 7 is fixed on the guide plate 7.2, and moves up and down along the guide rail, thereby achieving rigid guide of the guide-roller type elevator. An oil cylinder 7.3 is connected to the push rod 7.4 to push the swing block 7.9, so as to drive the holding sleeve 7.6 to clamp and loosen the pipe ferrule of the oil pipe, thereby ensuring synchronism of the clamping and loosening of the pipe ferrule by the holding sleeve 7.6. The holding sleeve 7.6 may be changed according to the different models of the oil pipe. The elevator body 7.5 and the pin shaft 7.7 are connected by using the suspension ring 7.8, so that installation is more convenient. One side of the guide pulley 7.1 is provided with a quick detachable structure which may be detached and separately placed while being transported. The slip 8 is connected to the wellhead, and achieves clamping and loosening of the oil pipe through locking an opening of the oil cylinder.

The entire machine is in a transporting state while being folded, and is in a working state while being expanded. The pendulum 4.1 of the truck-mounted folding type oil pipe manipulator rotates around a shaft on the pendulum base under actions of the sucker rods, so that a connection end surface of the pendulum and the boom achieves conversion between the vertical and the horizontal statuses. It is the working state when the connection end surface is in a vertical status to the ground, and it is the transporting state when the connection end surface is in a horizontal status. At this time, the boom 4.2 and the flexible manipulator 4.3 are located within the silo body which is above the baseplate assembly 1; and a front section of the boom is supported by a support rod. The random-folding type traveling block rigid guide device 3 enables, under driving of the hydraulic motor 3.9-1, the pendulum 3.2 to rotate on the base 3.1 by using the 3.3 as a center, thereby achieving a conversion between the working state and the transporting state. During a transporting state of the machine, the random-folding type traveling block rigid guide device 3 is entirely located within the silo body which is above the baseplate assembly 1. When an internal oil cylinder completely extends out, the detecting and conveying device 5 erects the device and shrinks the same to be within a transportation width of 2.5 m. Meanwhile, positioning pins at a rear end of a V-shaped angle iron for length measurement at two ends are opened, and positioning pins at a front end are locked. The oil cylinder shrinks the V-shaped angle iron at the two ends to be within a width range of two hydraulic legs, where a base anchor of the hydraulic legs may be shrinks to be above a bottommost surface of the baseplate assembly 1. Hereto, the entire auxiliary machine satisfies requirements for appearance and size of the conventional transporting state.

What is claimed is:

1. An automatic auxiliary workover rig, wherein comprising a baseplate assembly, a silo, a folding type traveling block rigid guide device, a guide-roller type elevator, a truck-mounted folding type oil pipe manipulator, a detecting and conveying device, and a transfer device; the folding type traveling block rigid guide device being hingedly connected to a rear end of the baseplate assembly, the guide-roller type elevator being mounted on the folding type traveling block rigid guide device, a portion of the truck-mounted folding type oil pipe manipulator being also hingedly connected to the rear end of the baseplate assembly and operating between the detecting and conveying device and the guide-roller type elevator, the silo being mainly a silo body and being provided on a baseplate, wherein the transfer device used in cooperation with the silo to be responsible for leading in and out of an oil pipe is provided on the baseplate assembly, and the detecting and conveying device used in cooperation with the silo has functions of detection, positioning, and transferring and is provided on the baseplate assembly, wherein the baseplate assembly comprises a baseplate, rams, and hydraulic legs, there are four hydraulic legs which are provided nearby four corners at two sides of the baseplate, so as to support the baseplate, the hydraulic legs are connected to the rams, and the rams are connected to the baseplate by using respective hydraulic cylinders to which the rams are connected.

2. The automatic auxiliary workover rig according to claim 1, wherein the folding type traveling block rigid guide device comprises a retractable guide device and a guide rail driving device; the retractable guide device comprising a guide rail; the guide rail driving device comprises a hydraulic motor, a pull rod, a sliding car, a decelerator, a transmission shaft, and a sprocket; two ends of a top portion of the silo body are respectively provided with the sprocket to be connected by a chain; the sliding car is provided on the chain; one end of the pull rod is hingedly connected to the sliding car, and the other end is hingedly connected to the guide rail; the hydraulic motor is connected to and drives the sprocket located at a beginning end by using the decelerator and the transmission shaft; then the chain is driven by the sprocket, so as to pull the sliding car; and the sliding car then pulls up and folds the retractable guide device by using the pull rod.

3. The automatic auxiliary workover rig according to claim 2, wherein the guide-roller type elevator comprises a vide pulley, a guide plate, an elevator oil cylinder, a push rod, an elevator body, a holding sleeve, a pin shaft, a suspension ring, and a swing block; the guide pulley is fixed on the guide plate; the guide pulley moves up and down along the guide rail in the folding type traveling block rigid guide device, thereby achieving rigid guide of the guide-roller type elevator; the guide plate is fixed on the elevator body; a center of the elevator body is provided with the holding sleeve which is longitudinally disposed; the swing block is hingedly connected within the elevator and at two sides of the holding sleeve; the oil pipe passing through the holding sleeve is clamped or loosened through rotation of the swing block; the guide plate is provided with the elevator oil cylinder which is connected to the push rod; a lower end of the push rod is hingedly connected to the swing block; the holding sleeve is driven to clamp or loosen a pipe ferrule of the oil pipe as the swing block is driven by the elevator oil cylinder, so as to make sure synchronism of the clamping and loosening of the pipe ferrule by the holding sleeve; the holding sleeve may be changed according to different models of the oil pipe; and the elevator body is configured to be connected to the suspension ring through the pin shaft; and one side of the guide pulley is provided with a quick detachable structure which may be detached and separately placed while being transported.

4. The automatic auxiliary workover rig according to claim 1, wherein further comprising a flatcar up-down adjustment device which comprises a left-right adjustment device and a front-rear adjustment device; the left-right adjustment device is mounted at a position near a rear section of the baseplate assembly in a left-right direction, and comprises a push rod and an oil cylinder; one end of the push rod is hingedly connected to the baseplate assembly, and the other end is hingedly connected to an earring at a cylinder head of the oil cylinder, wherein a position at which the push rod and the baseplate assembly are hingedly connected is inserted into a rectangular groove of a trailer by using a shaft; an earring at a cylinder bottom of the oil cylinder is hingedly connected to the baseplate assembly; when the oil cylinder pushes, a shaft at the position at which the push rod and the baseplate assembly are hingedly connected moves in the groove of the trailer; because the trailer stops on the ground and does not move, according to the principle of relative motion, the oil cylinder pushes the baseplate to move by using the push rod and a body of the oil cylinder; and the front-rear adjustment device is mounted at a position near a front section of the baseplate assembly in a front-rear direction, and having a same structure as that of the left-right adjustment device.

5. The automatic auxiliary workover rig according to claim 1, wherein the silo body may temporarily store some sucker rods of the oil pipe, and an internal of the silo body comprises a two-dimensional palletizing manipulator which can connect the oil pipe from internal and external of the silo body; the palletizing manipulator is mounted on a horizontal guide rail, and two ends of the horizontal guide rail are mounted on a vertical guide rail; the palletizing manipulator grabs the oil pipe along left-right and up-down movements of the horizontal guide rail and the vertical guide rail; the vertical guide rail is fixed on the silo body; a top portion of the silo body is provided with an upper connection cap; and two sides of the silo body are provided with a balancing device connected to the vertical guide rail, so as to balance dead weights of the horizontal and the vertical guide rails.

6. The automatic auxiliary workover rig according to claim 5, wherein the detecting and conveying device comprises a swing frame, a length measuring oil cylinder, conveying swing arms, a cross beam, a base, and swinging oil cylinders, the swing frame is mounted on the conveying swing arms for connecting and placing the oil pipe; the length measuring oil cylinder is mounted below the swing frame; the oil pipe is positioned through shrinkage and extension of the length measuring oil cylinder so that a length of the oil pipe is able to be measured by using a linear encoder to calculate the shrinkage and extension of the length measuring oil cylinder; there are two conveying swing arms which are provided at the front and the rear; the two swing arms are connected by a cross beam so as to be synchronous; swinging oil cylinders are provided within the conveying swing arms; the swinging oil cylinders are respectively hingedly connected to the base and the conveying swing arms, and are driven to swing around the base due to a swinging of the oil pipe, so as to lead the oil pipe into and out from the silo; the base is further connected to the baseplate assembly and is at a right side of the silo, such that the base is located at a same side with the truck-mounted folding type oil pipe manipulator; during a transporting state of the automatic auxiliary workover rig, the swinging oil cylinders completely extend out, so that an end surface of the conveying swing arms is in contact with the base.

7. The automatic auxiliary workover rig according to claim 5, wherein the transfer device comprising a transferring swing arm, a swinging oil cylinder, an ejecting slide block, a push plate, a lifting oil cylinder, and a base; the base is fixed at a side of the silo that is away from a wellhead; a front end of the swinging oil cylinder is hingedly connected to a bottom portion at a front end of the transferring swing arm, and a rear end is hingedly connected to the base; the ejecting slide block is provided at an upper end of the base and directly behind of the transferring swing arm; the lifting oil cylinder is provided below the ejecting slide block; a right side of the ejecting slide block is provided with an adjustment push plate; the sucker rods of the oil pipe are placed on the transferring swing arm; the transferring swing aim is pushed by the swinging oil cylinder to turn over; a distance from a front side to a rear side of the push plate is adjusted, so that when the ejecting slide block is lifted by the lifting oil cylinder, only one sucker rod of the oil pipe is allowed to be lifted by the ejecting slide block and the transferring swing arm is pushed to be in a vertical state when the automatic auxiliary workover rig is transporting.

8. The automatic auxiliary workover rig according to claim 1, wherein the truck-mounted folding type oil pipe manipulator comprises a pendulum, a swinging manipulator, and a flexible manipulator; the pendulum comprises a swing block, a pendulum base, a swinging oil cylinder, and a locking oil cylinder; the pendulum base is fixed on the baseplate assembly; the swing block is hingedly connected to the pendulum base; the swing block is driven by the swinging oil cylinder to rotate around the pendulum base, so as to achieve entire folding and placing, thereby facilitating transportation; one side of the pendulum is mounted with the locking oil cylinder which locks the swinging manipulator; the swinging manipulator is connected to the pendulum; a pulling oil cylinder and a first-stage sprocket are provided within the swinging manipulator, so that the swinging manipulator is enabled to rotate around the pendulum; an arm of the swinging manipulator is mounted with a chain tensioning device, so as to tension the chain; the flexible manipulator is hingedly connected to a shaft at which a top end of the swinging manipulator is located, and a shaft end of the shaft is provided with a second-stage sprocket; the first-stage sprocket and the second-stage sprocket are connected by using a second-stage chain; the flexible manipulator is driven by the second-stage chain on the second-stage sprocket to rotate around the shaft together with the swinging manipulator; a difference between rotation angles of the two manipulators is kept 90° C. by using number of sprocket teeth; the flexible manipulator is mounted with an elevating oil cylinder; and when the grippers grab the oil pipe, the elevating oil cylinder may elevate the grippers and the oil pipe by using the combination of an elevating shaft sleeve.

* * * * *